US009661983B1

(12) United States Patent
Gonzales

(10) Patent No.: US 9,661,983 B1
(45) Date of Patent: May 30, 2017

(54) SHOE CLEANING APPARATUS

(71) Applicant: Robert Gonzales, Ontario (CA)

(72) Inventor: Robert Gonzales, Ontario (CA)

( * ) Notice: Subject to any disclaimer, the term of this patent is extended or adjusted under 35 U.S.C. 154(b) by 0 days.

(21) Appl. No.: 15/165,933

(22) Filed: May 26, 2016

(51) Int. Cl.

| | |
|---|---|
| ***A47L 23/02*** | (2006.01) |
| ***A47L 23/26*** | (2006.01) |
| ***A46B 13/02*** | (2006.01) |
| ***A46B 13/04*** | (2006.01) |
| ***A47L 23/20*** | (2006.01) |

(52) U.S. Cl.
CPC ..... *A47L 23/02* (2013.01); *A46B 13/02* (2013.01); *A46B 13/04* (2013.01); *A47L 23/20* (2013.01); *A47L 23/26* (2013.01); *A47L 23/263* (2013.01); *A46B 2200/306* (2013.01)

(58) Field of Classification Search
CPC ..... A47L 23/00; A47L 23/02; A47L 23/22; A47L 23/26; A47L 23/263; A46B 11/00; A46B 13/00; A46B 13/02; A46B 13/024; A46B 15/00; A46B 2200/306; A46B 13/04
USPC ..... 15/4, 21.1, 34, 36, 97.2
See application file for complete search history.

(56) References Cited

U.S. PATENT DOCUMENTS

| | | | | |
|---|---|---|---|---|
| 3,032,794 A | | 5/1962 | Stevens | |
| 3,641,609 A | | 2/1972 | Hansen | |
| 4,358,867 A | * | 11/1982 | Berta | A47L 23/263 15/36 |
| 4,724,564 A | | 2/1988 | Fresh | |
| 5,950,269 A | * | 9/1999 | Openshaw | A46B 13/001 15/34 |
| 2008/0289127 A1 | * | 11/2008 | Guy | A47L 23/02 15/36 |

FOREIGN PATENT DOCUMENTS

| | | | |
|---|---|---|---|
| JP | 8-84699 | * | 4/1996 |
| JP | 11-239562 | * | 9/1999 |
| JP | 2002-191543 | * | 7/2002 |
| JP | 2008-23245 | * | 2/2008 |

* cited by examiner

*Primary Examiner* — Mark Spisich
(74) *Attorney, Agent, or Firm* — Stevenson IP, LLC

(57) ABSTRACT

A shoe cleaning apparatus including a housing unit having an interior compartment, an opening medially disposed through a top side of the housing unit, and a circular threaded aperture disposed through the top side proximal the opening. A horizontal axis rotary brush having a plurality of bristles is disposed within the opening of the housing unit. A motorized drive belt mechanism is disposed within the housing unit. The motorized drive belt mechanism is configured to rotate the horizontal axis rotary brush. A shoe drying mat has a rear surface attached to a bottom front edge of the housing unit. Each of a front splash guard and a back splash guard of a pair of vertically disposed adjustable dome-shaped splash guards is slidably attached to each of an inner front surface and an inner back surface, respectively, of the opening of the housing unit.

3 Claims, 5 Drawing Sheets

SHOE CLEANING APPARATUS

BACKGROUND OF THE INVENTION

Various types of shoe cleaners are known in the prior art. However, what has been needed is a shoe cleaning apparatus including a housing unit having an interior compartment, an opening medially disposed through a top side of the housing unit, and a circular threaded aperture disposed through the top side proximal the opening. What has been further needed is a horizontal axis rotary brush having a plurality of bristles disposed within the opening of the housing unit and a motorized drive belt mechanism disposed within the housing unit. The motorized drive belt mechanism is configured to rotate the horizontal axis rotary brush. Lastly, what has been needed is a shoe drying mat having a rear surface attached to a bottom front edge of the housing unit and each of a front splash guard and a back splash guard of a pair of vertically disposed adjustable dome-shaped splash guards slidably attached to each of an inner front surface and an inner back surface, respectively, of the opening of the housing unit. The shoe cleaning apparatus thus provides a user with an easy and portable way in which to clean the bottom surface of a pair of shoes prior to tracking mud and other unwanted material into a house. The shoe cleaning apparatus is ideally suited for contractors and other workers who are often forced to walk into a client's house with unclean shoes. Not only does the shoe cleaning apparatus promote sanitary conditions by preventing the spread of germs, but the shoe drying mat ensures that moisture is not spread onto the floors either.

FIELD OF THE INVENTION

The present invention relates to shoe cleaners, and more particularly, to a shoe cleaning apparatus.

SUMMARY OF THE INVENTION

The general purpose of the present shoe cleaning apparatus, described subsequently in greater detail, is to provide a shoe cleaning apparatus which has many novel features that result in a shoe cleaning apparatus which is not anticipated, rendered obvious, suggested, or even implied by prior art, either alone or in combination thereof.

To accomplish this, the present shoe cleaning apparatus includes a housing unit having a top side, a bottom side, a right side, a left side, a front side, a back side, an interior compartment, an opening medially disposed through the top side, and a circular threaded aperture disposed through the top side proximal the opening. The opening has an inner right surface, an inner left surface, an inner front surface, and an inner back surface. Each of the housing unit and the opening of the housing unit is optionally an elongated rectangular in order to better fit a shoe of a user. A threaded cap is selectively engageable with the threaded aperture and removably disposed atop the threaded aperture. A power cord has a first end attached to a power connector disposed within the housing unit and a second end selectively attachable to a power source.

The shoe cleaning apparatus further includes a horizontal axis rotary brush continuously disposed within the opening of the housing unit from the inner right surface to the inner left surface. The horizontal axis rotary brush has an outer surface and a plurality of bristles continuously disposed on an entirety of the outer surface. The plurality of bristles is rotatably disposed above the top side of the housing unit. A motorized drive belt mechanism is disposed within the housing unit, with the motorized drive belt mechanism operatively connected to the horizontal axis rotary brush. The motorized drive belt mechanism is configured to rotate the horizontal axis rotary brush. An activation control is disposed on the top side of the housing unit. The activation control is configured to activate the motorized drive belt mechanism to rotate the horizontal axis rotary brush. The location of the activation control on the top side of the housing unit allows the activation control to be foot-activated for the convenience of the user. The power connector, the power source, the horizontal axis rotary brush, the motorized drive belt mechanism, and the activation control are in operational communication with each other.

A drain opening is disposed through one of the right side of the housing unit and the left side of the housing unit proximal the bottom side. A drain plug is removably disposed within an entirety of the drain opening. A shoe drying mat is disposed immediately adjacent to the front side of the housing unit, with the show drying mat having an absorbent upper surface and a rear surface attached to a bottom front edge of the housing unit. A length of the shoe drying mat is optionally equal to a length of the housing unit. Lastly, each of a front splash guard and a back splash guard of a pair of vertically disposed adjustable dome-shaped splash guards is slidably attached to each of the inner front surface and the inner back surface, respectively, of the opening of the housing unit. Each of the front splash guard and the back splash guard is configured to slidably retract and, alternately, extend inward toward the horizontal axis rotary brush depending on a size of a shoe disposed between the pair of splash guards. A length of each of the front splash guard and the back splash guard substantially conforms to the length of the housing unit.

A cleaning liquid is configured to be pourable through the threaded aperture and into the interior compartment such that the plurality of bristles of the horizontal axis rotary brush is rotatably disposed within the cleaning liquid. Thus, when the motorized drive belt mechanism has been activated, the plurality of bristles will rotate through the cleaning liquid and clean the shoe of the user that has been placed atop the housing unit and between the pair of splash guards. The pair of splash guards helps to ensure that the floor immediately proximal the housing unit remains dry and clean. The drying mat further helps to ensure that the user is able to dry his newly washed shoes prior to walking into the house.

Thus has been broadly outlined the more important features of the present shoe cleaning apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
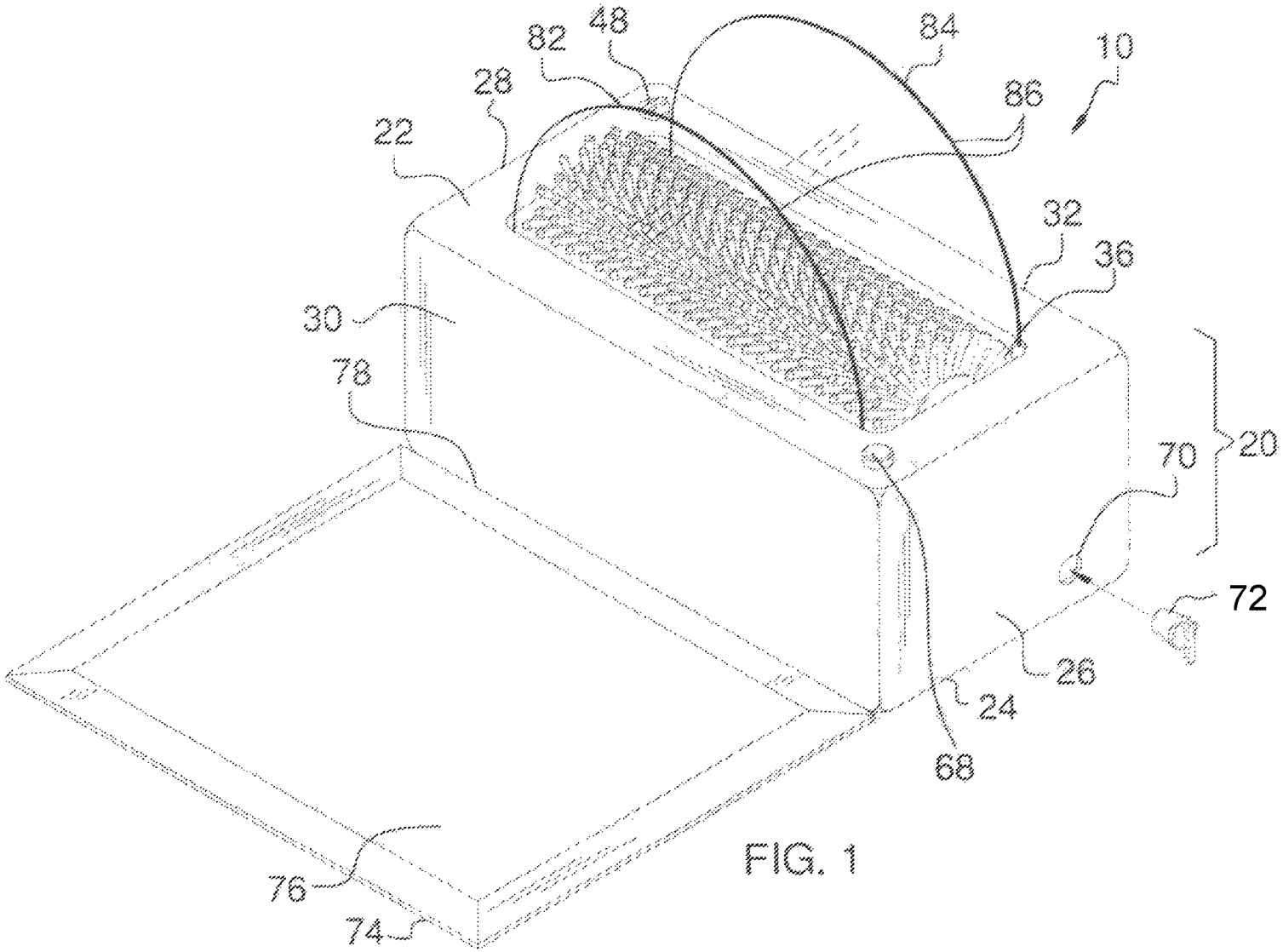
FIG. 1 is a front isometric view.
Figure 2:
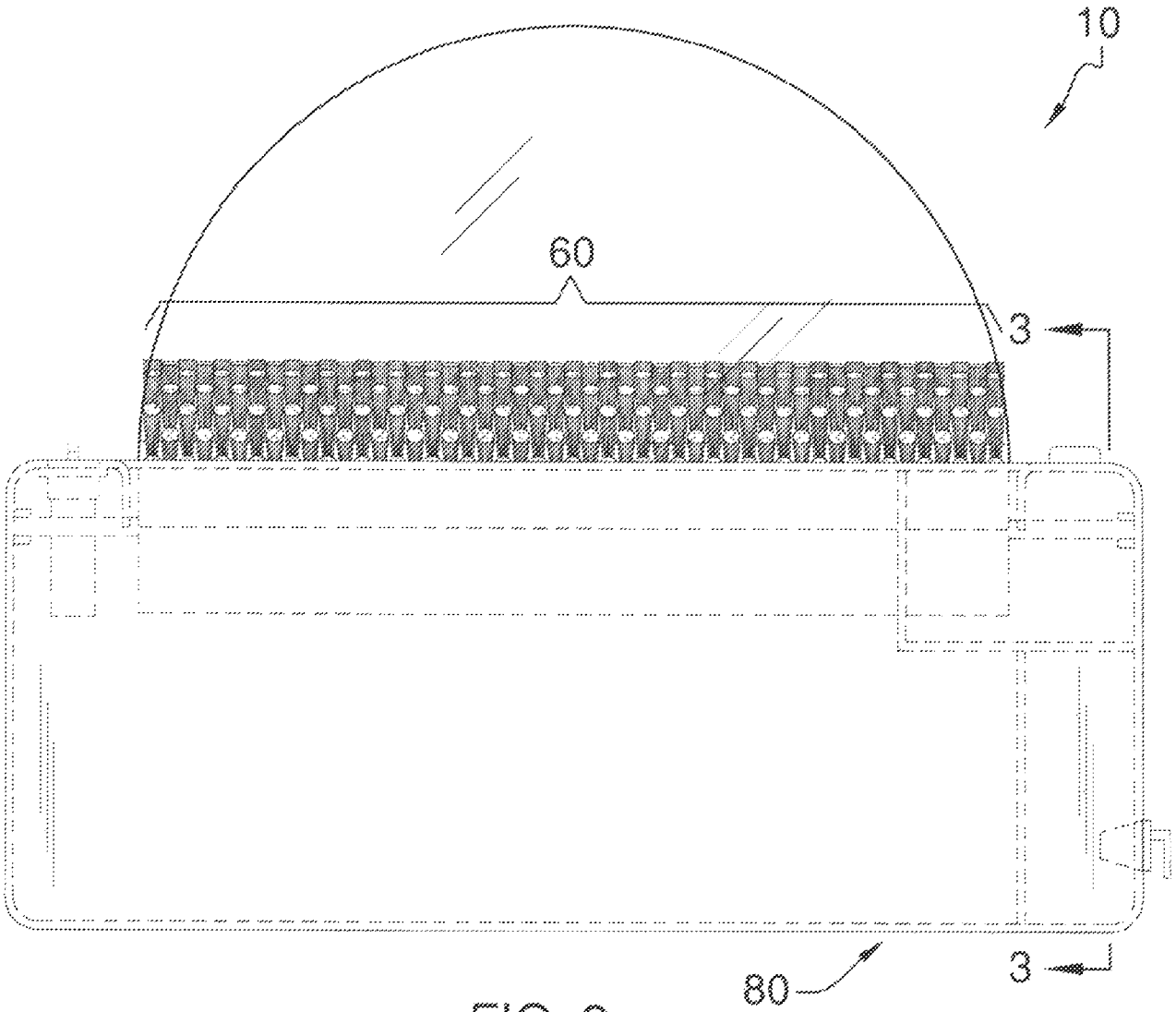
FIG. 2 is a front elevation view.
Figure 3:
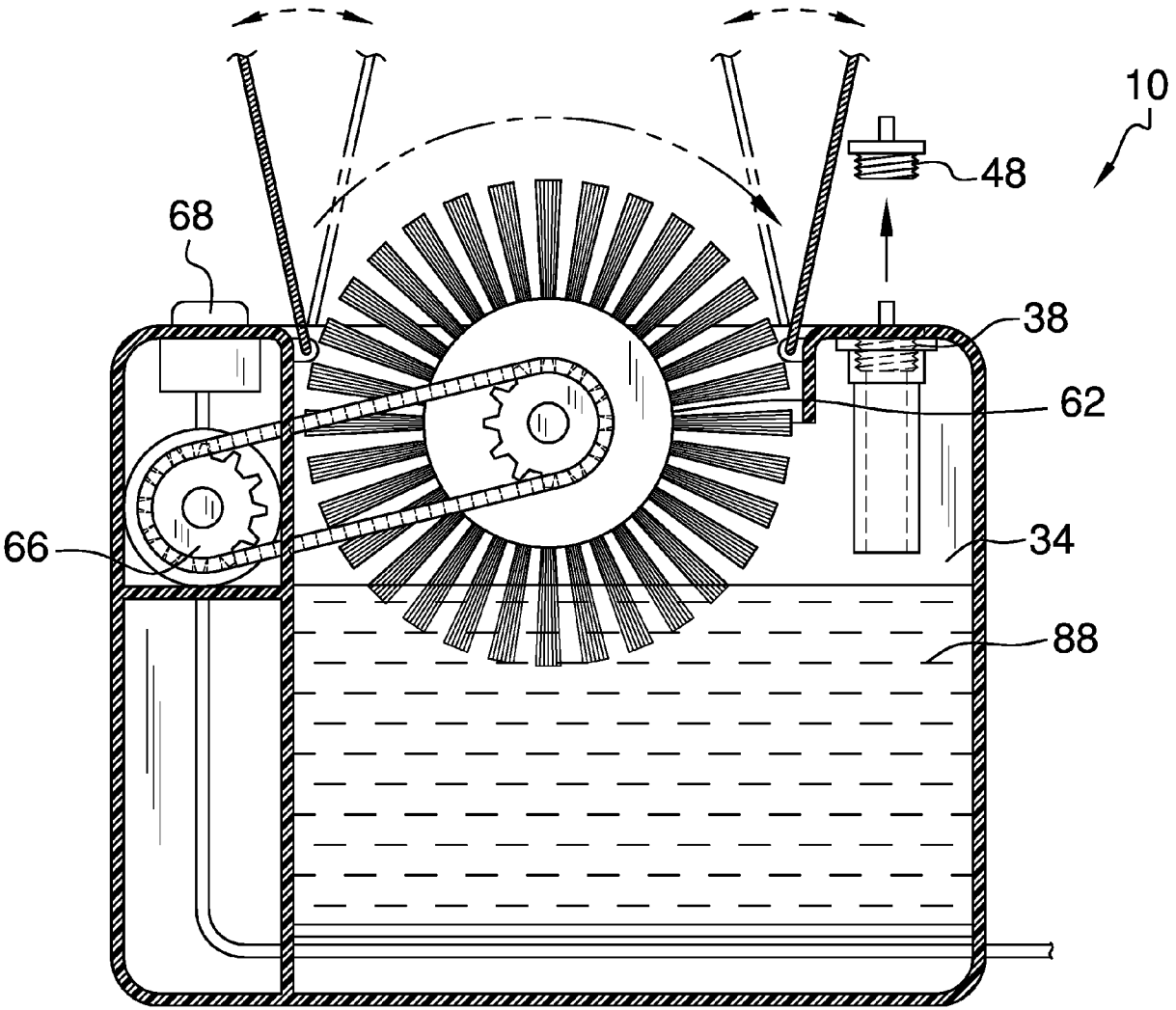
FIG. 3 is a cross-sectional view taken along line 3-3 of FIG. 2.
Figure 4:
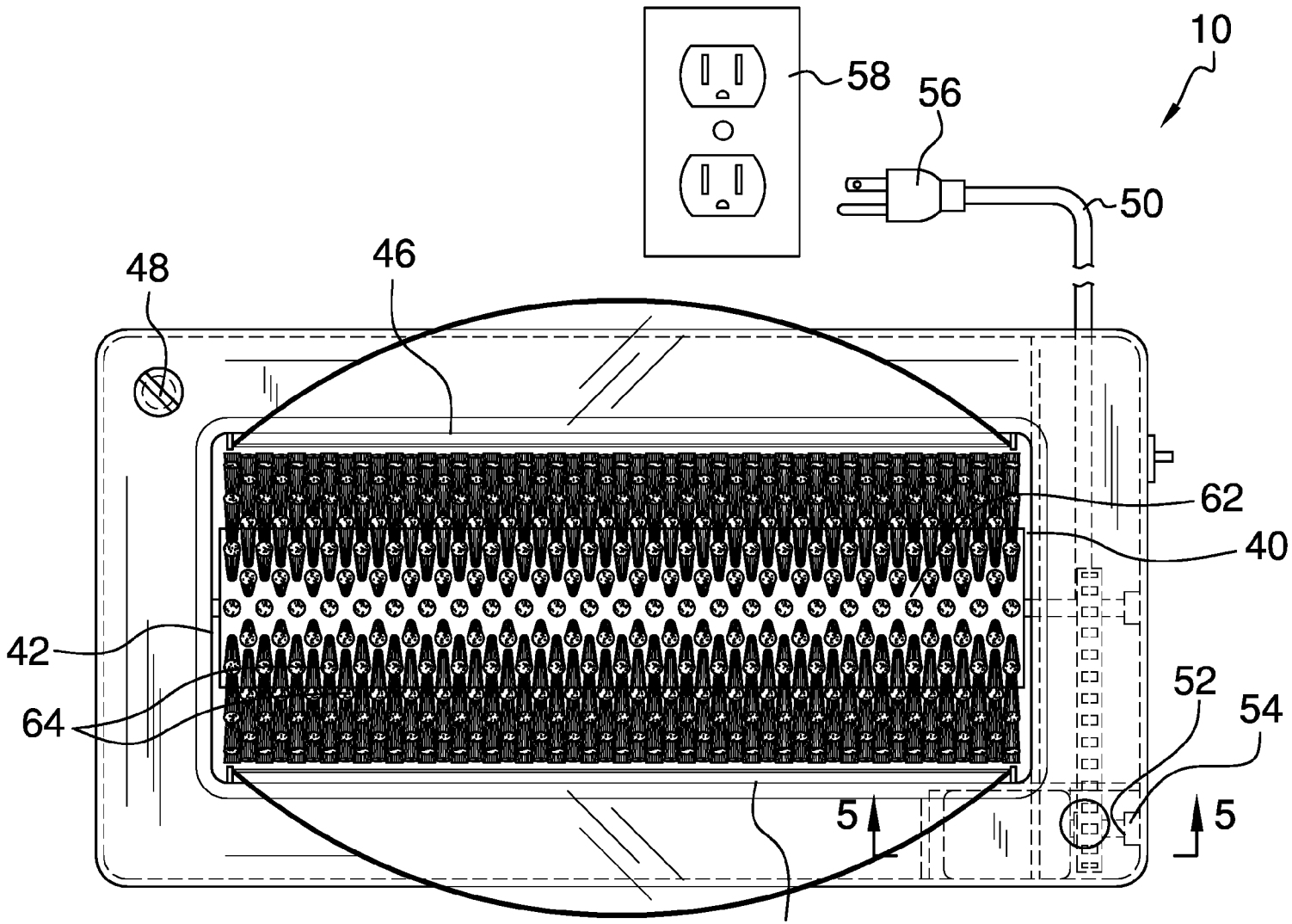
FIG. 4 is a top plan view.
Figure 5:
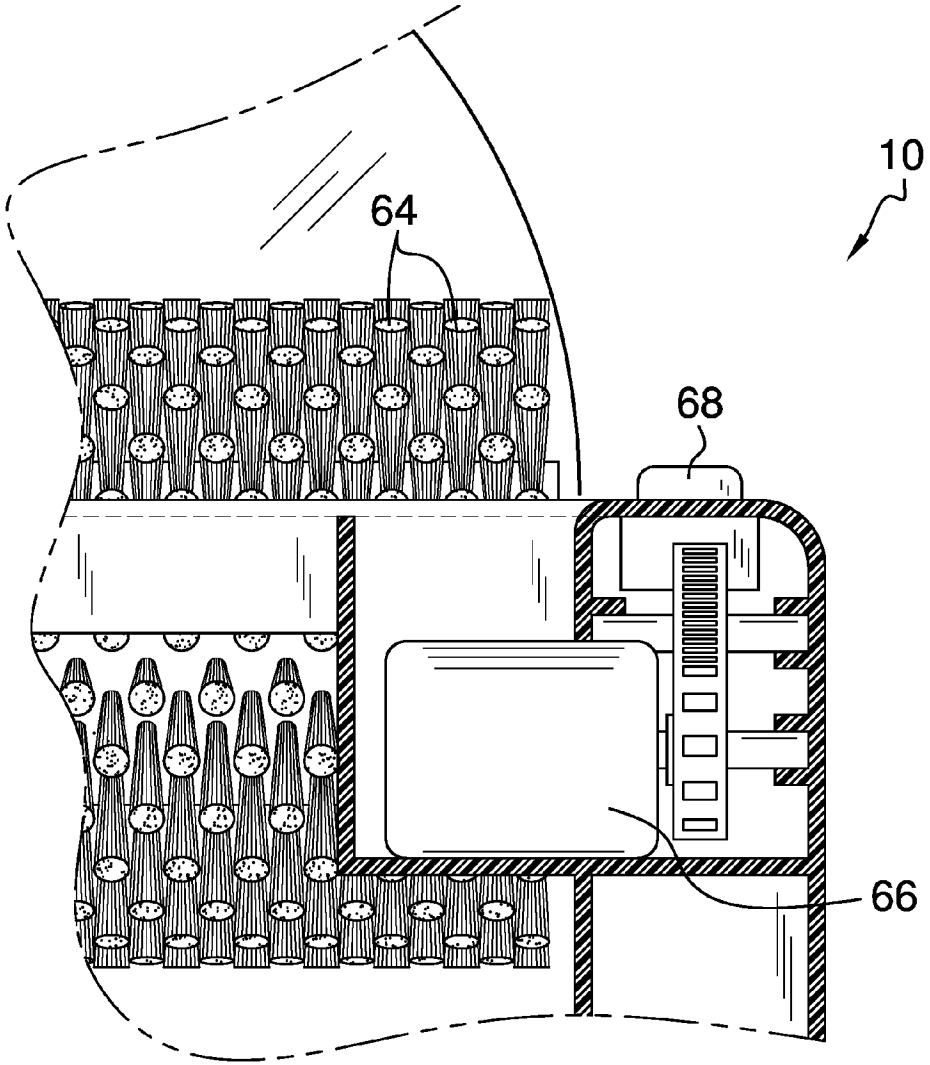
FIG. 5 is a cross-sectional view taken along line 5-5 of FIG. 4.

With reference now to the drawings, and in particular FIGS. 1 through 5 thereof, an example of the instant shoe cleaning apparatus employing the principles and concepts of the present shoe cleaning apparatus and generally designated by the reference number 10 will be described.

Referring to FIGS. 1 through 5 the present shoe cleaning apparatus 10 is illustrated. The shoe cleaning apparatus 10 includes a housing unit 20 having a top side 22, a bottom side 24, a right side 26, a left side 28, a front side 30, a back side 32, an interior compartment 34, an opening 36 medially disposed through the top side 22, and a circular threaded aperture 38 disposed through the top side 22 proximal the opening 36. The opening 36 has an inner right surface 40, an inner left surface 42, an inner front surface 44, and an inner back surface 46. Each of the housing unit 20 and the opening 36 of the housing unit 20 is optionally an elongated rectangular. A threaded cap 48 is selectively engageable with the threaded aperture 38 and removably disposed atop the threaded aperture 38. A power cord 50 has a first end 52 attached to a power connector 54 disposed within the housing unit 20 and a second end 56 selectively attachable to a power source 58.

The shoe cleaning apparatus 10 further includes a horizontal axis rotary brush 60 continuously disposed within the opening 36 of the housing unit 20 from the inner right surface 40 to the inner left surface 42. The horizontal axis rotary brush 60 has an outer surface 62 and a plurality of bristles 64 continuously disposed on an entirety of the outer surface 62. The plurality of bristles 64 is rotatably disposed above the top side 22 of the housing unit 20. A motorized drive belt mechanism 66 is disposed within the housing unit 20, with the motorized drive belt mechanism 66 operatively connected to the horizontal axis rotary brush 60. The motorized drive belt mechanism 66 is configured to rotate the horizontal axis rotary brush 60. An activation control 68 is disposed on the top side 22 of the housing unit 20. The activation control 68 is configured to activate the motorized drive belt mechanism 66 to rotate the horizontal axis rotary brush 60. The power connector 54, the power source 58, the horizontal axis rotary brush 60, the motorized drive belt mechanism 66, and the activation control 68 are in operational communication with each other.

A drain opening 70 is disposed through one of the right side 26 of the housing unit 20 and the left side 28 of the housing unit 20 proximal the bottom side 24. A drain plug 72 is removably disposed within an entirety of the drain opening 70. A shoe drying mat 74 is disposed immediately adjacent to the front side 30 of the housing unit 20, with the show drying mat 74 having an absorbent upper surface 76 and a rear surface 78 attached to a bottom front edge 80 of the housing unit 20. A length of the shoe drying mat 74 is optionally equal to a length of the housing unit 20. Lastly, each of a front splash guard 82 and a back splash guard 84 of a pair of vertically disposed adjustable dome-shaped splash guards 86 is slidably attached to each of the inner front surface 44 and the inner back surface 46, respectively, of the opening 36 of the housing unit 20. Each of the front splash guard 82 and the back splash guard 84 is configured to slidably retract and, alternately, extend inward toward the horizontal axis rotary brush 60 depending on a size of a shoe disposed between the pair of splash guards 86. A length of each of the front splash guard 82 and the back splash guard 84 substantially conforms to the length of the housing unit 20.

A cleaning liquid 88 is configured to be pourable through the threaded aperture 38 and into the interior compartment 34 such that the plurality of bristles 64 of the horizontal axis rotary brush 60 is rotatably disposed within the cleaning liquid 88.

What is claimed is:

1. A shoe cleaning apparatus comprising:

a housing unit having a top side, a bottom side, a right side, a left side, a front side, a back side, an interior compartment, an opening medially disposed through the top side, and a circular threaded aperture disposed through the top side proximal the opening, the opening having an inner right surface, an inner left surface, an inner front surface, and an inner back surface;

a threaded cap selectively engageable with the threaded aperture, wherein the cap is removably disposed atop the threaded aperture;

a power cord having a first end attached to a power connector disposed within the housing unit and a second end selectively attachable to a power source;

a horizontal axis rotary brush continuously disposed within the opening of the housing unit from the inner right surface to the inner left surface, the horizontal axis rotary brush having an outer surface and a plurality of bristles continuously disposed on an entirety of the outer surface, wherein the plurality of bristles is rotatably disposed above the top side of the housing unit;

a motorized drive belt mechanism disposed within the housing unit, the motorized drive belt mechanism operatively connected to the horizontal axis rotary brush;

wherein the motorized drive belt mechanism is configured to rotate the horizontal axis rotary brush;

an activation control disposed on the top side of the housing unit;

wherein the activation control is configured to activate the motorized drive belt mechanism to rotate the horizontal axis rotary brush;

a drain opening disposed through one of the right side of the housing unit and the left side of the housing unit proximal the bottom side;

a drain plug removably disposed within an entirety of the drain opening;

a shoe drying mat disposed immediately adjacent to the front side of the housing unit, the shoe drying mat having an absorbent upper surface and a rear surface attached to a bottom front edge of the housing unit; and a pair of vertically disposed adjustable dome-shaped splash guards comprising a front splash guard and a back splash guard, each of the front splash guard and the back splash guard slidably attached to each of the inner front surface and the inner back surface, respectively, of the opening of the housing unit;

wherein each of the front splash guard and the back splash guard is configured to slidably retract and, alternately, extend inward toward the horizontal axis rotary brush depending on a size of a shoe disposed between the pair of splash guards;

wherein a length of each of the front splash guard and the back splash guard substantially conforms to a length of the housing unit;

wherein the power connector, the power source, the horizontal axis rotary brush, the motorized drive belt mechanism, and the activation control are in operational communication with each other;

wherein a cleaning liquid is configured to be pourable through the threaded aperture and into the interior compartment such that the plurality of bristles of the horizontal axis rotary brush is rotatably disposed within the cleaning liquid.

2. The shoe cleaning apparatus of claim 1 wherein a length of the shoe drying mat is equal to the length of the housing unit.

3. The shoe cleaning apparatus of claim 2 wherein each of the housing unit and the opening of the housing unit is an elongated rectangle.

* * * * *